US012765590B2

(12) United States Patent
Zhang

(10) Patent No.: US 12,765,590 B2
(45) Date of Patent: Oct. 20, 2026

(54) TOBACCO PRODUCT HOLDING DEVICE

(71) Applicant: Shenzhen Limao E-Commerce Co., Ltd., Shenzhen (CN)

(72) Inventor: Wei Zhang, Shenzhen (CN)

(73) Assignee: Shenzhen Limao E-Commerce Co., Ltd., Shenzhen (CN)

( * ) Notice: Subject to any disclaimer, the term of this patent is extended or adjusted under 35 U.S.C. 154(b) by 89 days.

(21) Appl. No.: 18/907,585

(22) Filed: Oct. 6, 2024

(65) Prior Publication Data

US 2025/0344760 A1 Nov. 13, 2025

Related U.S. Application Data

(63) Continuation-in-part of application No. 29/941,938, filed on May 13, 2024, now Pat. No. Des. 1,051,491.

(51) Int. Cl.
*A24F 13/22* (2006.01)

(52) U.S. Cl.
CPC ..... *A24F 13/22* (2013.01)

(58) Field of Classification Search
None
See application file for complete search history.

(56) References Cited

U.S. PATENT DOCUMENTS 3,387,614 A * 6/1968 Beuscher ..... A24F 19/10 131/240.1
5,706,832 A * 1/1998 Gold ..... A24F 13/22 131/250
2001/0048012 A1* 12/2001 Ferrari ..... B60R 11/00 224/183

* cited by examiner

*Primary Examiner* — Phu H Nguyen

(57) ABSTRACT

A tobacco product holding device includes: a seat; a first holding member; and a second holding member. The first holding member is mounted on the seat and has a first holding portion. The second holding member is mounted on the seat. A first gap is defined between the first holding portion and the second holding member, the first holding member is configured to resiliently oscillate in a direction away from or approaching the second holding member to enable a tobacco product to be held within the first gap. At least one of the first holding member and the second holding member has a guiding surface extending towards the first gap, the guiding surface is configured to guide the tobacco product to enter the first gap.

19 Claims, 10 Drawing Sheets

TOBACCO PRODUCT HOLDING DEVICE

CROSS-REFERENCE TO RELATED APPLICATIONS

The present application is a continuation-in-part application of the U.S. design patent application Ser. No. 29/941,938, filed on May 13, 2024, and contents of which are incorporated herein by its entireties.

TECHNICAL FIELD

The present disclosure relates to the field of smoking appliances, and in particular to a tobacco product holding device.

BACKGROUND

A tobacco product holding device is a tool for holding a tobacco product. For example, a cigar holder is substantially configured to hold or place a cigar. The cigar holder may be used during playing golf and may be mounted to a frame of a golf cart. In the art, the tobacco product holding device has a tobacco product holding structure, consisting of two blocks opposite to each other. The two blocks are hinged to each other. A spring or a torsion spring is arranged to connect the two blocks to each other. The holding structure has a pressing end and a holding end. The holding end is configured to hold the tobacco product. A releasing-holding action of the pressing end is opposite to a releasing-holding action of the holding end. The user may press the pressing end to enable the holding end to release the tobacco product. However, for the tobacco product holding device in the art, regardless of the user taking the holding end to hold the tobacco product or removing the tobacco product from the holding end, the user needs to firstly pinch the pressing end to unlock the holding end, and then performs other operations. Therefore, the tobacco product holding device in the art cannot be used conveniently.

SUMMARY OF THE DISCLOSURE

The present disclosure provides a tobacco product holding device, including: a seat; a first holding member; and a second holding member. The first holding member is mounted on the seat and has a first holding portion. The second holding member is mounted on the seat. A first gap is defined between the first holding portion and the second holding member, the first holding member is configured to resiliently oscillate in a direction away from or approaching the second holding member to enable a tobacco product to be held within the first gap. At least one of the first holding member and the second holding member has a guiding surface extending towards the first gap, the guiding surface is configured to guide the tobacco product to enter the first gap.

BRIEF DESCRIPTION OF THE DRAWINGS

In order to more clearly illustrate the technical solutions in embodiments of the present disclosure or in the art, the accompanying drawings to be used in the embodiments or in the art will be briefly introduced in the following. Obviously, the following description of the accompanying drawings shows only some of the embodiments of the present disclosure. Any ordinary skilled person in the art may obtain other drawings based on the following drawings without creative work.

Figure 1:
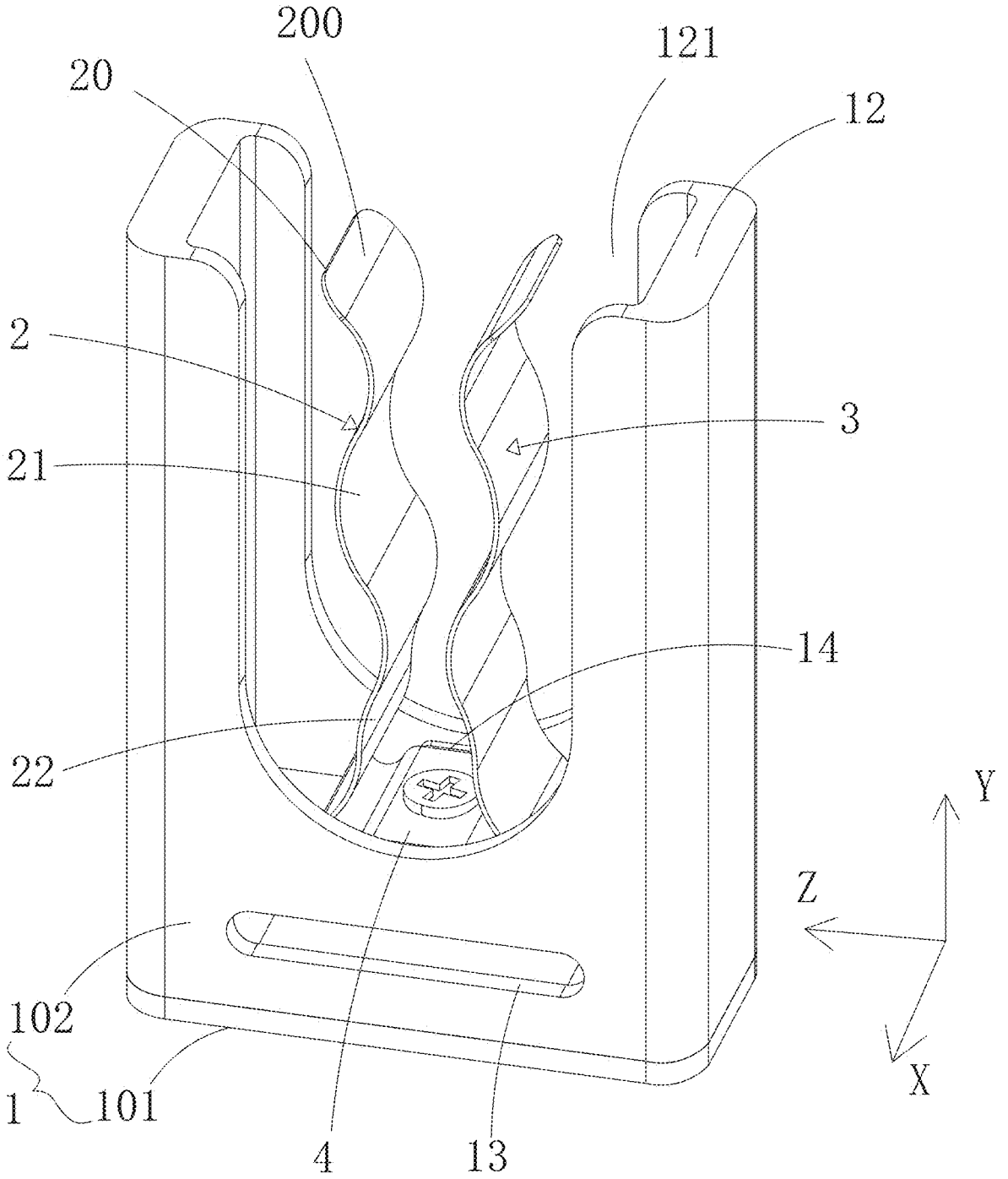
FIG. 1 is a schematic view of the entirety of a tobacco product holding device according to embodiments of the present disclosure.
Figure 2:
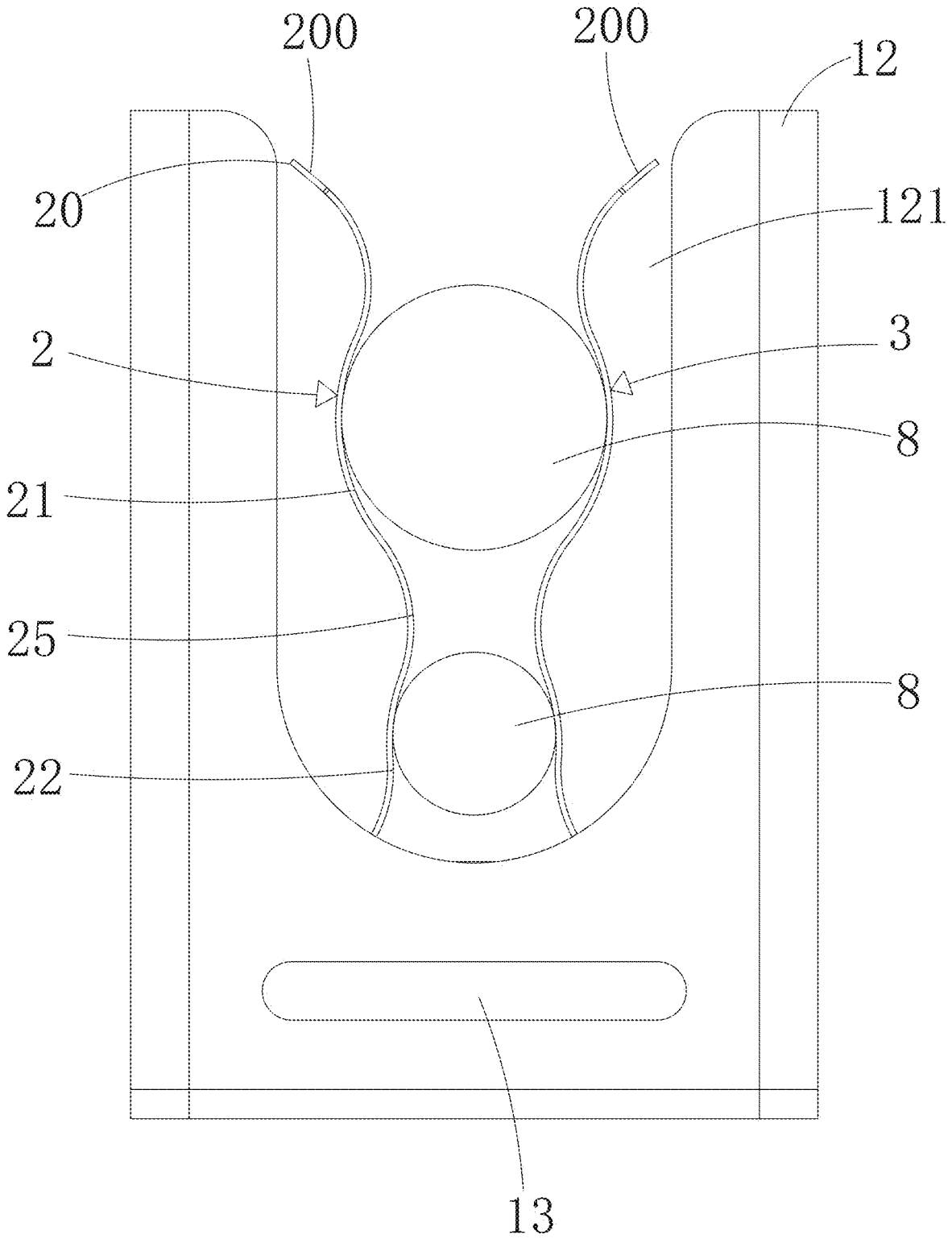
FIG. 2 is a schematic view of the tobacco product holding device being in use according to embodiments of the present disclosure.

REFERENCE NUMERALS IN THE DRAWINGS seat 1, base 101, connection tab 1011, outer housing 102, connection slot 1021, mounting slot 11, protective tab 12, holding notch 121, connection hole 13, anti-rotation slot 14;

first holding member 2, guiding end 20, guiding surface 200, side 201 of the guiding end facing the second holding member, first holding portion 21, first gap 210, width 2100 of a widest position of the first gap, side 211 of the first holding portion facing the second holding member, first curved slot 212, sawtoothed structure 212*a*, straight slot structure 212*b*, second holding portion 22, second gap 220, width 2200 of a widest position of the second gap, side 221 of the second holding portion facing the second holding member, second curved slot 222, lower segment 23, upper segment 24, side 231 of the lower segment facing the second holding member, side 241 of the upper segment facing the second holding member, transition portion 25, third gap 250, width 2500 of a narrowest position of the third gap, second holding member 3;

connection member 4;

magnetic member 5;

sealing piece 6;

connection band 7, hairy surface 71, hook surface 72;

tobacco product 8.

DETAILED DESCRIPTION

Unless otherwise defined, all technical and scientific terms used herein have the same meanings as being commonly understood by any ordinary skilled person in the art. The terms used herein in the specification of the present disclosure are used only for the purpose of describing specific embodiments and shall not be interpreted as limiting the present disclosure. The terms "include" and "have" and any variations thereof, used in the specification, claims and the drawings of the present disclosure are intended to cover non-exclusive embodiments. The terms "first", "second", and so on in the specification, claims and the accompanying drawings of the present disclosure are used to distinguish between different objects and are not used to describe a particular order.

Reference to "embodiments" herein implies that particular features, structures, or characteristics described in an embodiment may be included in at least one embodiment of the present disclosure. The presence of the phrase at various sections in the specification does not necessarily refer to the same embodiment, nor a separate or alternative embodiment that is mutually exclusive of other embodiments. It is understood by any ordinary skilled person in the art, both explicitly and implicitly, that the embodiments described herein may be combined with other embodiments.

In order to allow any ordinary skilled person in the art to better understand the embodiments of the present disclosure, technical solutions in the embodiments of the present disclosure will be clearly and completely described below by referring to the accompanying drawings.

As shown in FIGS. 1 to 10, the present disclosure provides a tobacco product holding device including a seat 1, a first holding member 2 and a second holding member 3.

The first holding member 2 and the second holding member 3 are both mounted on the seat 1. The first holding member 2 has a first holding portion 21. A first gap 210 is defined between the first holding portion 21 and the second holding member 3. The first holding member 2 resiliently oscillates in a direction away from or approaching the second holding member 3, and correspondingly, the first gap 210 is increased or decreased, such that the tobacco product 8 is held within the first gap 210. In a normal state, the tobacco product 8 is not held between the first holding member 2 and the second holding member 3, and in this case, the first holding member 2 and the second holding member 3 do not contact each other. At least one of the first holding member 2 and the second holding member 3 has a guiding surface 200 extending towards the first gap 210. The guiding surface 200 is configured to guide the tobacco product 8 to enter the first gap 210. The guiding surface 200 may be a flat surface or a curved surface or a spherical surface. In addition, the second holding member 3 may be fixedly mounted on a base 101, or the second holding member 3 may resiliently oscillate in the direction away from or approaching the first holding member 2.

Therefore, when the tobacco product 8 in a hand of a user moves towards the first gap 210, the tobacco product 8 firstly abuts against the guiding surface 200 and then slides into the first gap 210 along the guiding surface 200. During the above process, the tobacco product 8 compresses the first holding member 2, enabling the first holding member 2 to oscillate resiliently in the direction away from the second holding member 3, and increasing the first gap 210. At the same time, the first holding member 2 has a reverse action force applied on the tobacco product 8 to press the tobacco product 8 against the second holding member 3. When the first gap 210 is increased to be large enough to receive the tobacco product 8, the first holding member 2 and the second holding member 3 both take a resilient force to hold and secure the tobacco product 8. When the user needs to take out the tobacco product 8, the user can directly extract the tobacco product 8. In this case, the first holding member 2 is automatically reset due to the resilient force, and the user does not need to perform any additional operation to unlock the tobacco product 8 from the device. The operation can be performed by only one hand, which is convenient and fast. On the other hand, taking the resilient force to hold the tobacco product 8 allows the tobacco product holding device to be applicable to hold various tobacco products 8 having various thicknesses.

As shown in FIG. 1, a forward direction along an X-axis is defined as a front, and a rear direction along the X-axis is defined as a rear. An upward direction along a Y-axis is defined as an upper, and a downward direction along the Y-axis is defined as a lower. Directions described hereinafter are referred to the above definitions.

Figure 4:
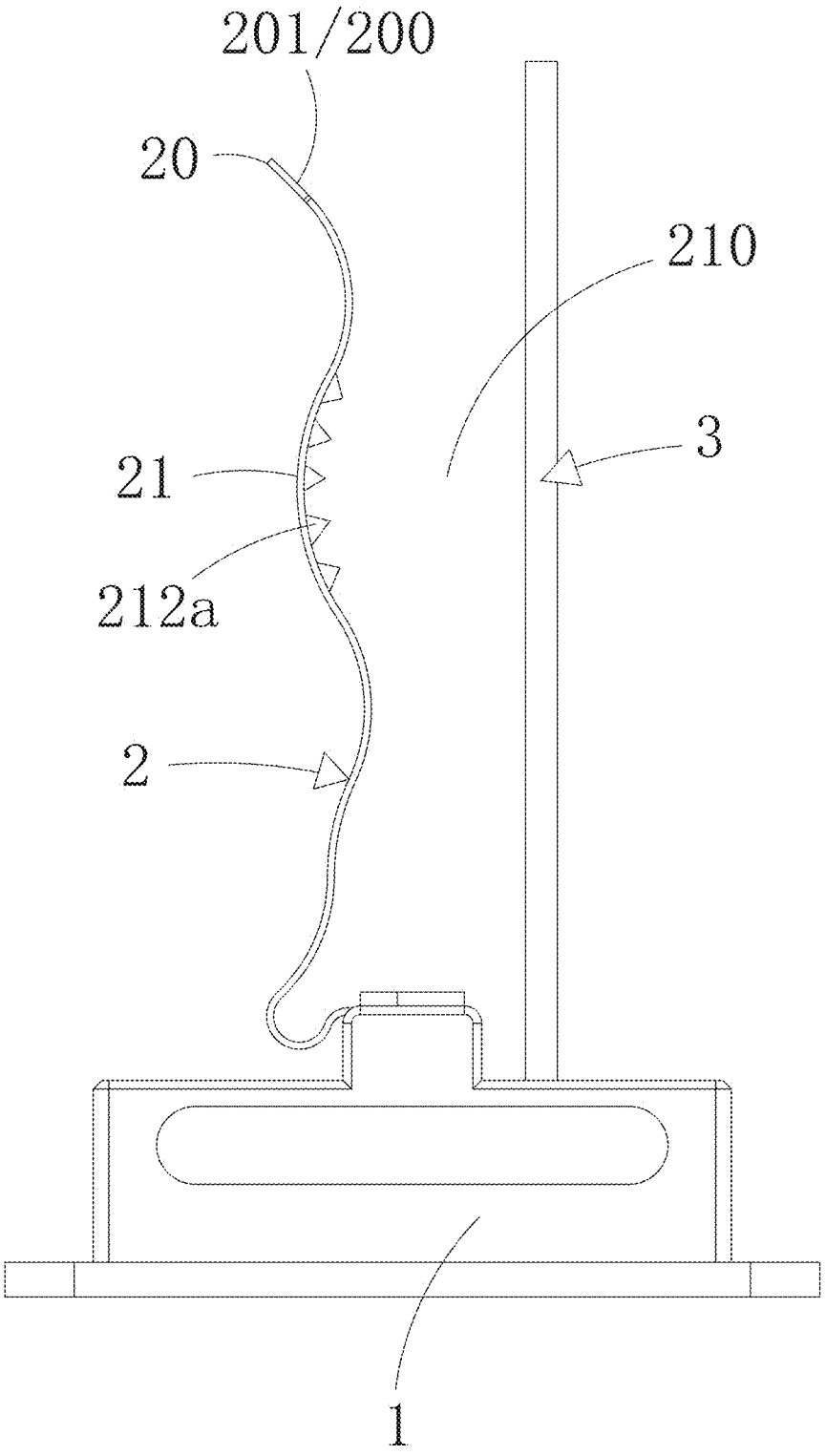
FIG. 4 is a schematic view of a first holding member and a second holding member according to embodiments of the present disclosure.

In an embodiment, as shown in FIG. 4, the second holding member 3 is fixedly mounted to the base 101. An end of the first holding member 2 away from the seat 1 is a guiding end 20. The guiding end 20 is inclined upwardly in a direction away from the second holding member 3. In this way, a side 201 of the guiding end 20 facing towards the second holding member 3 forms a guiding surface 200. The first holding portion 21 is a sawtoothed structure 212*a* arranged along an up-down direction.

Figure 5:
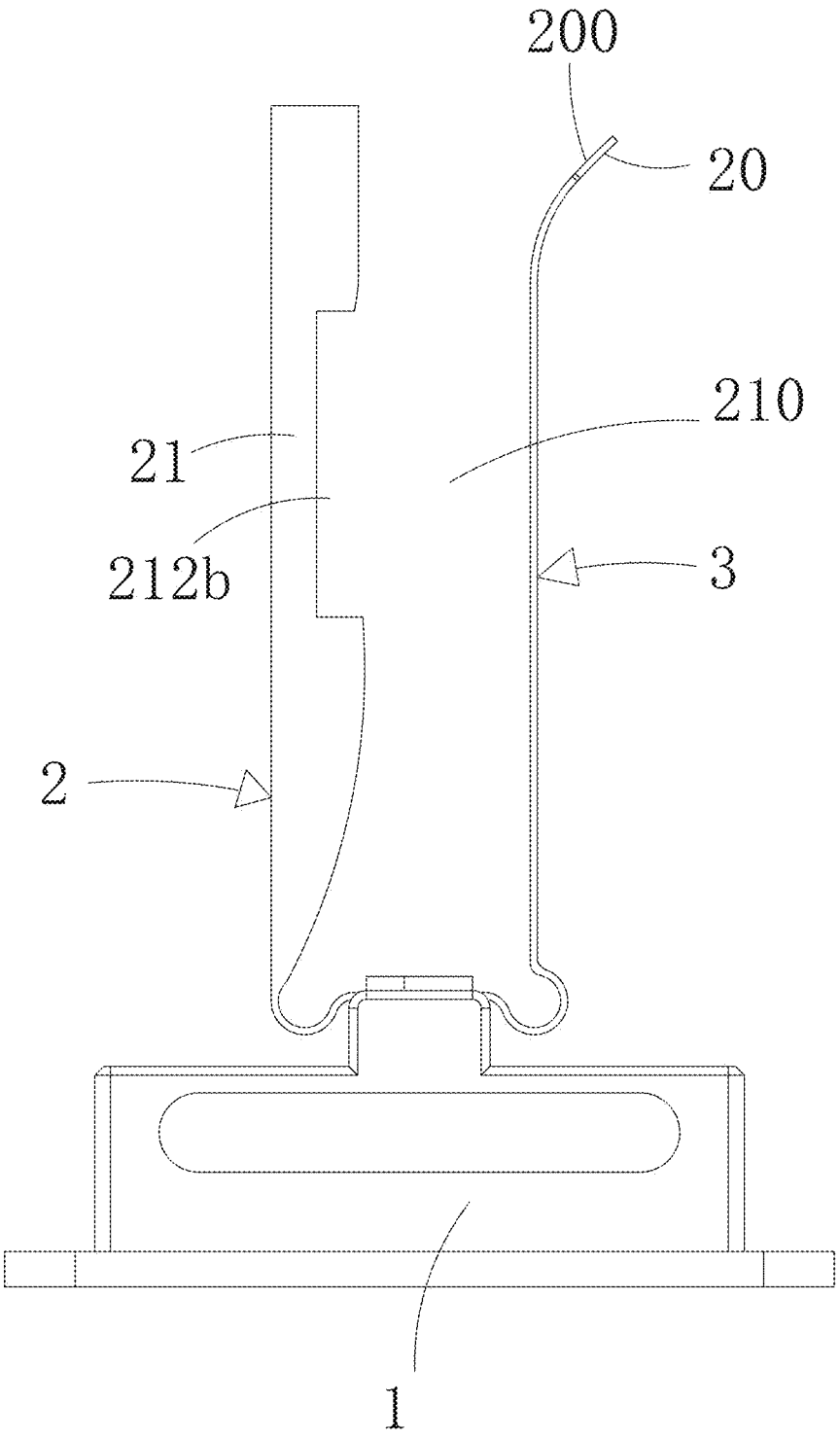
FIG. 5 is a schematic view of the first holding member and the second holding member according to other embodiments of the present disclosure.

In another embodiment, as shown in FIG. 5, the second holding member 3 resiliently oscillates in a direction away from or approaching the first holding member 2. An end of the second holding member 3 away from the seat 1 is the guiding end 20. The guiding end 20 is inclined upwardly in a direction away from the first holding member 2. In this way, a side of the guiding end 20 facing towards the first holding member 2 forms the guiding surface 200. The first holding portion 21 is a straight slot structure 212*b* arranged along an up-down direction. The straight slot structure 212*b* extends through the first holding member 2 in a front-rear direction.

Figure 6:
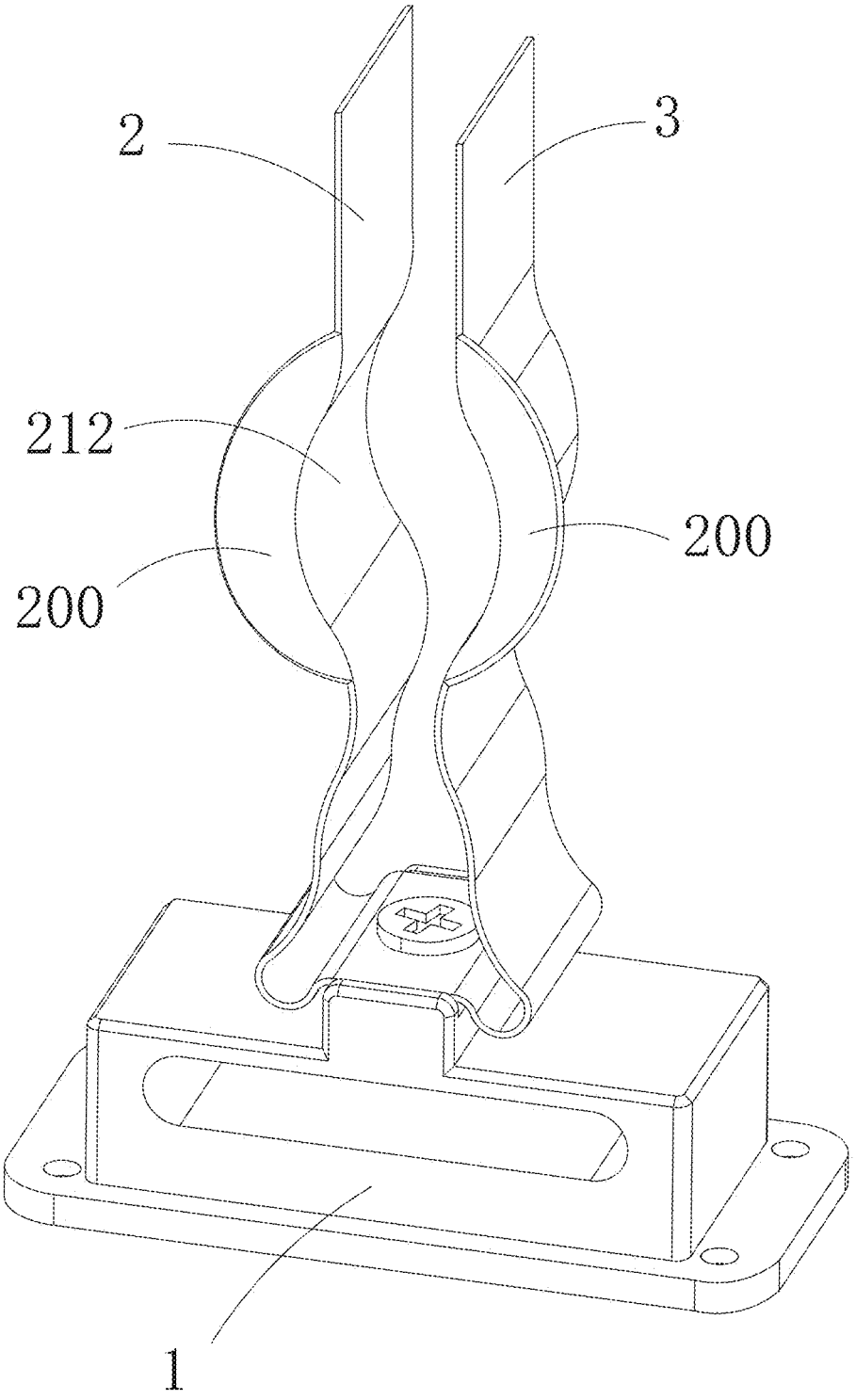
FIG. 6 is a schematic view of the first holding member and the second holding member according to yet other embodiments of the present disclosure, where a guiding surface is arranged in a front of the first curved slot.

In a further embodiment, as shown in FIG. 6, a side 211 of the first holding portion 21 facing the second holding member 3 defines a first curved slot 212. A vertical cross-section of the first curved slot 212 is curved. The guiding surface 200 of the first holding member 2 and the guiding surface 200 of the second holding member 3 are both located at a front of the first curved slot 212.

Figure 7:
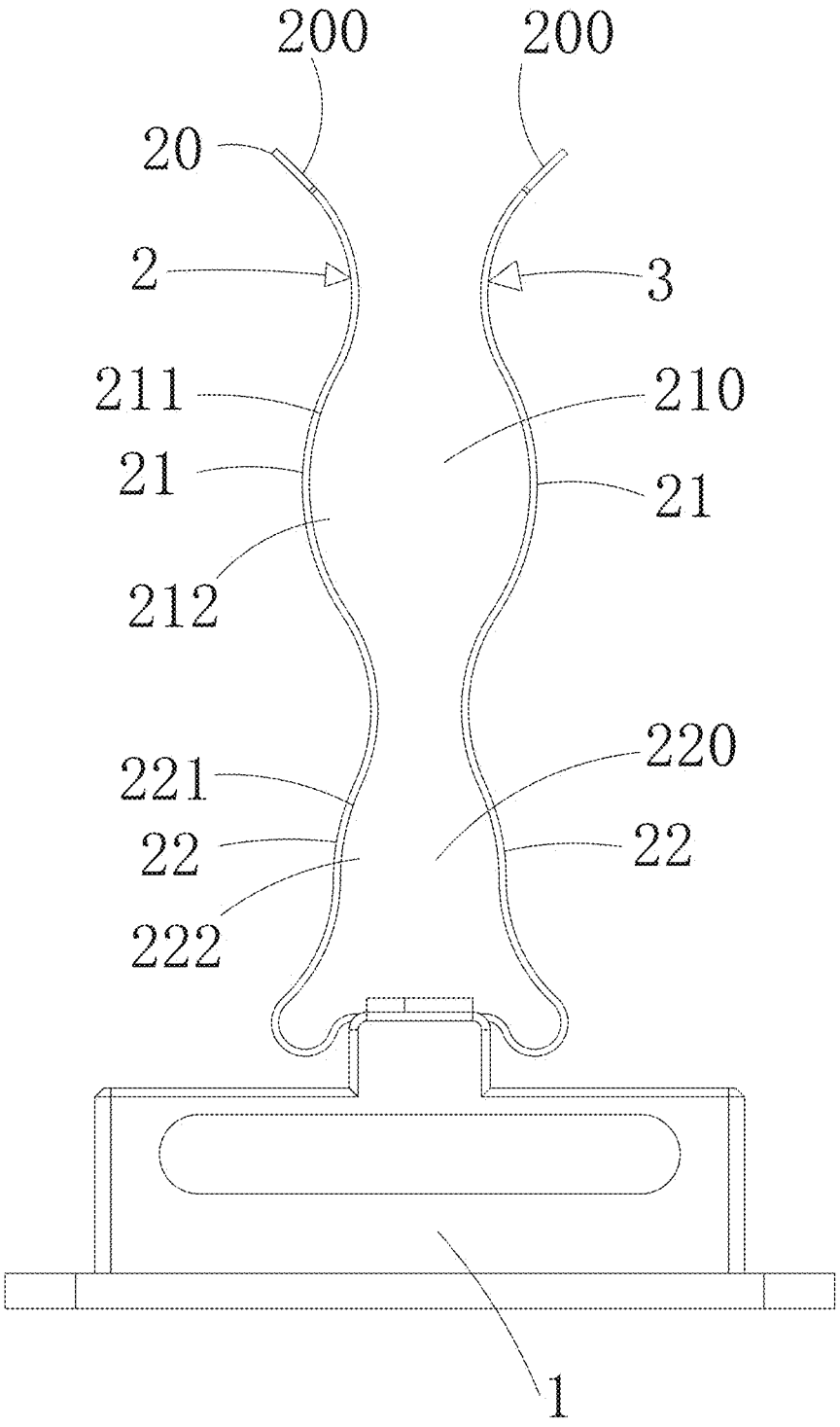
FIG. 7 is a schematic view of the first holding member and the second holding member according to some embodiments of the present disclosure.

In an embodiment, as shown in the FIG. 7, each of the first holding member 2 and the second holding member 3 has the guiding end 20 at the respective end away from the seat 1. The guiding end 20 of the first holding member 2 and the guiding end 20 of the second holding member 3 extend in opposite directions and are inclined upwardly, such that opposite sides of the two guiding ends 20 form two guiding surfaces 200 respectively. That is, the guiding end 20 of the first holding member 2 is inclined upwardly and extends in a direction away from the second holding member 3, such that a side of the guiding end 20 of the first holding member 2 facing towards the second holding member 3 forms the guiding surface 200. In addition, the second holding member 3 resiliently oscillates in the direction away from or approaching the first holding member 2, and the guiding end 20 of the second holding member 3 is inclined upwardly and extends in a direction away from the first holding member 2, such that a side of the guiding end 20 of the second holding member 3 facing towards the first holding member 2 forms the guiding surface 200. A side 211 of the first holding portion 21 facing the second holding member 3 defines a first curved slot 212. A vertical cross-section of the first curved slot 212 is curved. Defining the first curved slot 212 prevents the first holding member 2 and the second holding member 3 from damaging an outer skin of the tobacco product 8.

Further, the first holding member 2 further has a second holding portion 22, a second gap 220 is defined between the second holding portion 22 and the second holding member 3. The second gap 220 is communicated to the first gap 210. The tobacco product 8 may also be held in the second gap 220. The first holding portion 21 and the second holding portion 22 may have a same structural configuration or different structural configurations. In this way, the tobacco product configuration device may simultaneously hold two tobacco products 8 having different thicknesses, such as cigars in two sizes.

Specifically, as shown in FIG. 7, the second holding portion 22 is closer to the seat 1 than the first holding portion 21 is. When the first holding member 2 and the second holding member 3 do not hold the tobacco product 8, a width at a widest position of the second gap 220 is less than a width 2100 at a widest position of the first gap 210. Therefore, a thicker tobacco product 8 may be held by the first holding portion 21, and a thinner tobacco product 8 may be held by the second holding portion 22.

In other embodiments, only the second holding member 3 has the second holding portion 22, or each the first holding member 2 and the second holding member 3 has a respective second holding portion 22.

In an embodiment, a side 221 of the second holding portion 22 facing the second holding member 3 defines a second curved slot 222. A vertical cross-section of the second curved slot 222 is curved. That is, the second holding portion 22 and the first holding portion 21 are configured in a same manner. The second curved slot 222 and the first curved slot 212 provide the same function, both preventing the first holding member 2 and the second holding member 3 from damaging the outer skin of the tobacco product 8.

Further, in an embodiment, each of the first holding member 2 and the second holding member 3 is in a sheet structure. The first holding member 2 is curved and bent to form the first holding portion 21 and the second holding portion 22. Each of the first holding member 2 and the second holding member 3 is made of stainless steel, enabling the first holding member 2 and the second holding member 3 to have sufficient strength and toughness. A difficulty for the user to change a shape of the first holding member 2 and a shape of the second holding member 3 is reduced, and the tobacco product 8 can be easily placed and held.

Figure 8:
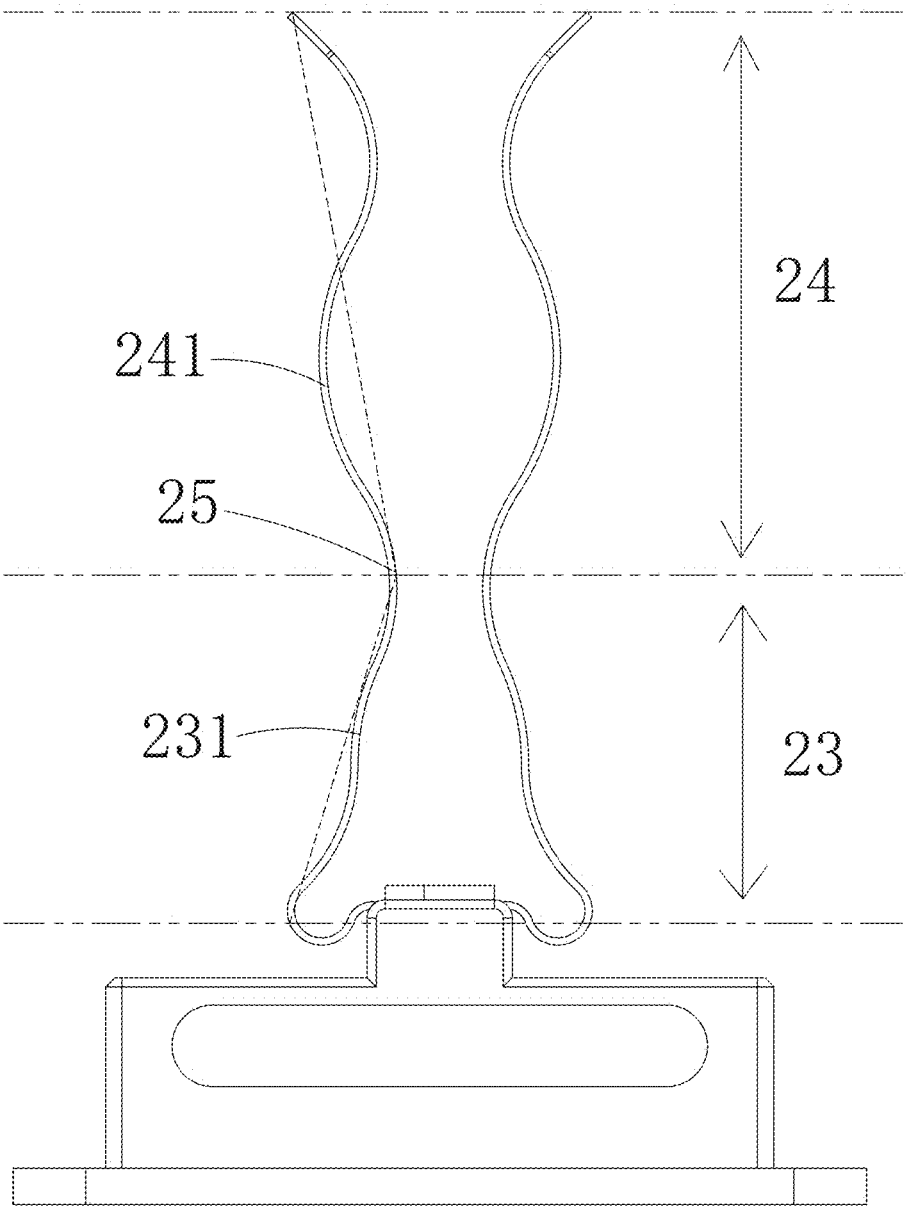
FIG. 8 is a schematic view of distribution of an upper segment and a lower segment according to some embodiments of the present disclosure.
Figure 9:
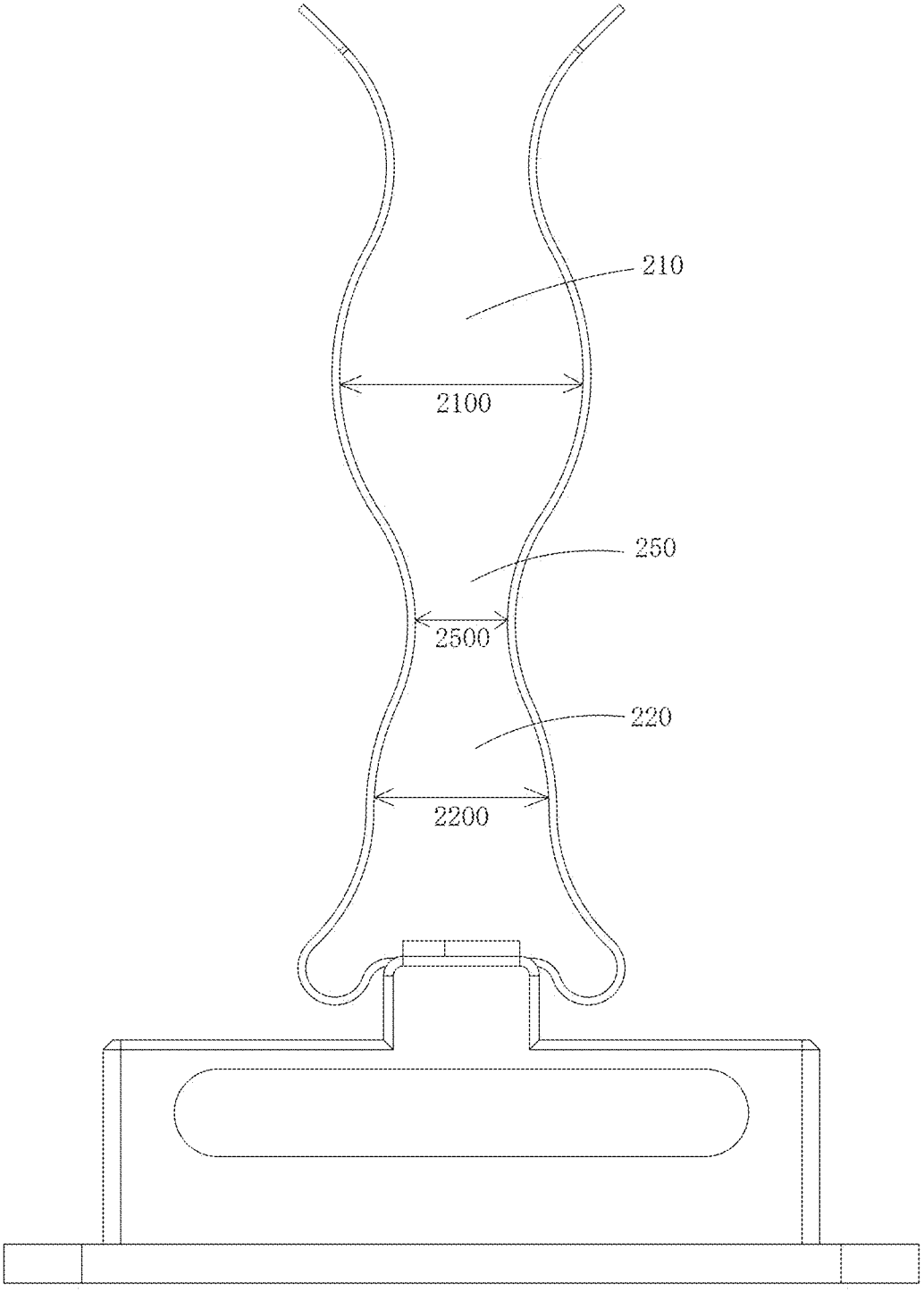
FIG. 9 is a schematic view of a first gap, a second gap, and a third gap according to some embodiments of the present disclosure.

In an embodiment, as shown in FIGS. 8 and 9, the first holding member 2 includes a lower segment 23 and an upper segment 24 arranged in a down-to-up direction. The lower segment 23 is arranged on the seat 1, a side 231 of the lower segment 23 facing the second holding member 3 is inclined along the down-to-up direction towards the second holding member 3. A side 241 of the upper segment 24 facing the second holding member 3 is inclined along the down-to-up direction away from the second holding member 3. The first holding portion 21 is arranged on the upper segment 24. The second holding portion 22 is arranged on the lower segment 23. A transition portion 25 is formed at a junction between the lower segment 23 and the upper segment 24. A third gap 250 is defined between the transition portion 25 and the second holding member 3, and the first gap 210, the third gap 250, and the second gap 220 are communicated to each other sequentially.

Therefore, the configuration of the first holding member 2 in the above embodiment prevents the tobacco product 8 having excessively large thickness from passing through the third gap 250 to be held in the second holding portion 22. On the one hand, the tobacco product 8 is prevented from being broken by an excessively large clamping force. On the other hand, the first holding member 2 and the second holding member 3 are prevented from being excessively deformed.

In an embodiment, the first holding member 2 and the second holding member 3 are structures mirrored to each other and are symmetrical to each other. That is, both the first holding member 2 and the second holding member 3 can resiliently oscillate. Each of the first holding member 2 and the second holding member 3 is arranged with the first holding portion 21, the second holding portion 22 and the guiding surface 200, respectively.

In order to achieve the above purpose, in the present embodiment, when the tobacco product 8 is not held between the first holding member 2 and the second holding member 3, the width 2100 of the first gap 210 at the widest position is in a range of 1.2 cm to 1.8 cm, preferably 1.4 cm. The width 2200 of the second gap 220 at the widest position is in a range of 0.7 cm to 1.3 cm, preferably 1 cm. When the tobacco product 8 is not held between the first holding member 2 and the second holding member, a width 2500 of the third gap 250 at a narrowest position is in a range of 0.5 cm to 1 cm, preferably 0.7 cm.

Figure 3:
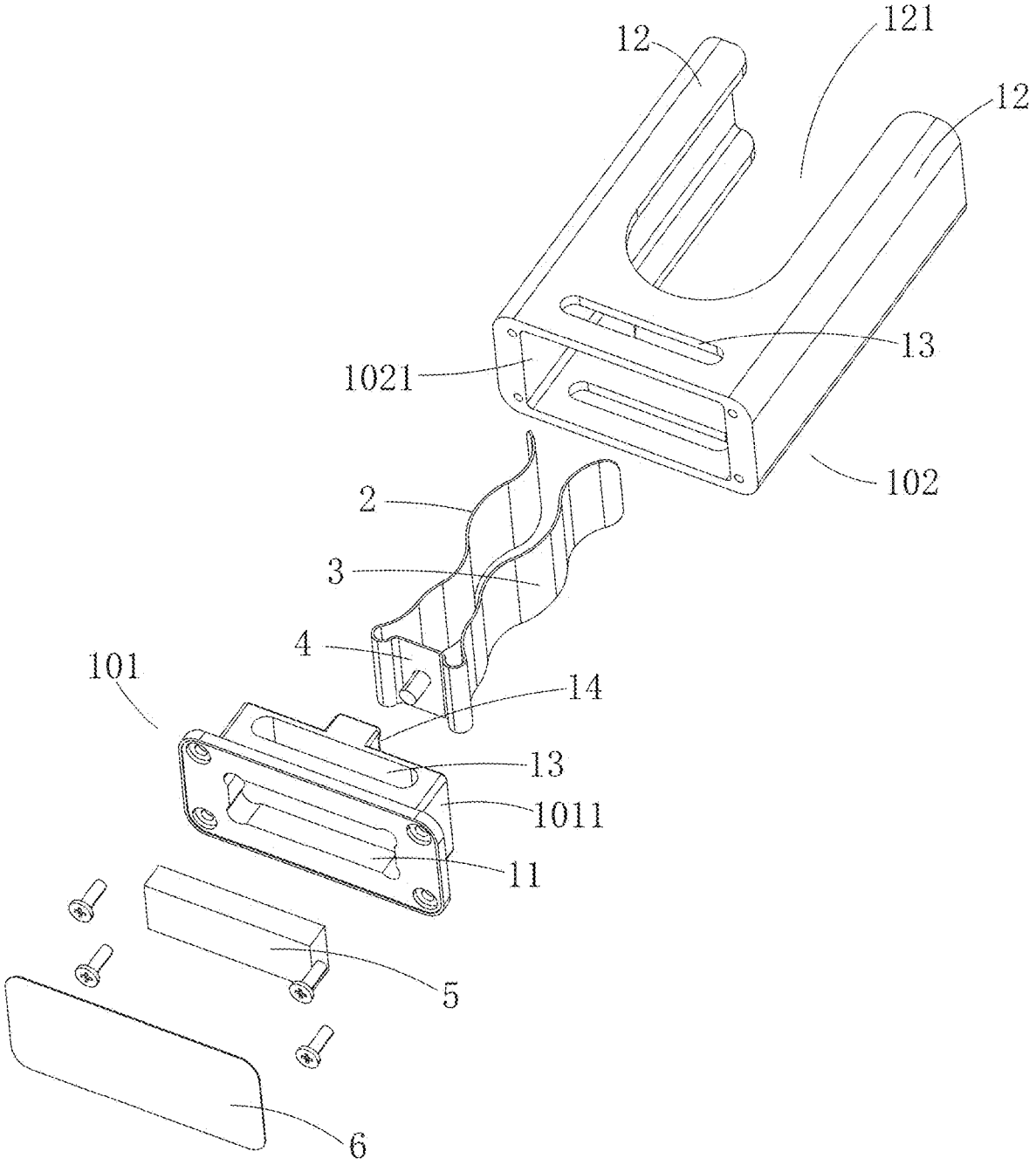
FIG. 3 is an exploded view of assembling the tobacco product holding device according to embodiments of the present disclosure.

Further, as shown in FIG. 3, the tobacco product holding device further includes a connection member 4, the connection member 4 is also configured as a sheet structure. The connection member 4 is fixedly mounted to the seat 1 by screws. The first holding member 2 and the second holding member 3 are both connected to the connection member 4. In an embodiment, the first holding member 2, the second holding member 3 and the connection member 4 are configured as a one-piece and integral structure. That is, the first holding member 2, the second holding member 3 and the connection member 4 are from by one piece of stainless steel being bent. The first holding member 2, the second holding member 3 and the connection member 4 cooperatively form a holding member.

In addition, in order to prevent the holding member from rotating, an anti-rotation structure, such as the anti-rotation slot 14 in FIGS. 1 and 3, may be arranged on the seat 1, or the connection member 4 may be secured by two screws together.

Further, as shown in FIG. 3, the tobacco product holding device further includes a magnetic member 5, mounted on the seat 1. The seat 1 can be mounted, by magnetic attraction, to a metal object containing iron, cobalt, and nickel. For example, the seat 1 may be magnetically attracted to a metal frame of a golf cart. Therefore, the magnetic member 5 is arranged to allow the tobacco product holding device to be removed and mounted easily and quickly. The tobacco product holding device may be mounted and removed conveniently.

Further, a mounting slot 11 is defined in a bottom surface of the seat 1. The magnetic member 5 is adhesively connected to a slot wall of the mounting slot 11. The tobacco product holding device further includes a sealing piece 6. The sealing piece 6 is adhesively attached to the seat 1 and covers the mounting slot 11. In an embodiment, the sealing piece 6 is a Mylar sheet, configured to prevent the magnetic member 5 from being exposed and to provide a polished contact surface.

Further, in order to prevent the first holding member 2 or the second holding member 3 from being damaged by impact, in an embodiment, the seat 1 is further arranged with a protective tab 12 extending upwardly. The protective tab 12 defines a holding notch 121 in the up-to-down direction.

The holding notch 121 extends through the protective tab 12 in the front-to-rear direction. The first holding member 2 and the second holding member 3 are arranged in the holding notch 121. The tobacco product 8 extends through the holding notch 121 to be held between the first holding member 2 and the second holding member 3. In addition, an extending height of the protective tab 12 is greater than a height of the first holding member 2 and a height of the second holding member 3. In this way, the first holding member 2 and the second holding member 3 are entirely disposed inside the holding notch 121.

Specifically, the seat 1 includes a base 101 and an outer housing 102. The base 101 has a connection tab 1011, and the connection member 4 is fixedly mounted on the connection tab 1011 by screws, correspondingly enabling the first holding member 2 and the second holding member 3 to be mounted on the connection tab 1011. The protective tab 12 and the holding notch 121 are arranged on the outer housing 102. A bottom of the outer housing 102 further defines a connection slot 1021 extending upwardly and communicated to the holding notch 121. A cross section of the connection slot 1021 and a cross section of the connection tab 1011 have a same shape. The base 101 is fixedly connected to the bottom of the outer housing 102, the connection tab 1011 is inserted into the connection slot 1021, and the base 101 is then fixed to the outer housing 102 by screws.

Figure 10:
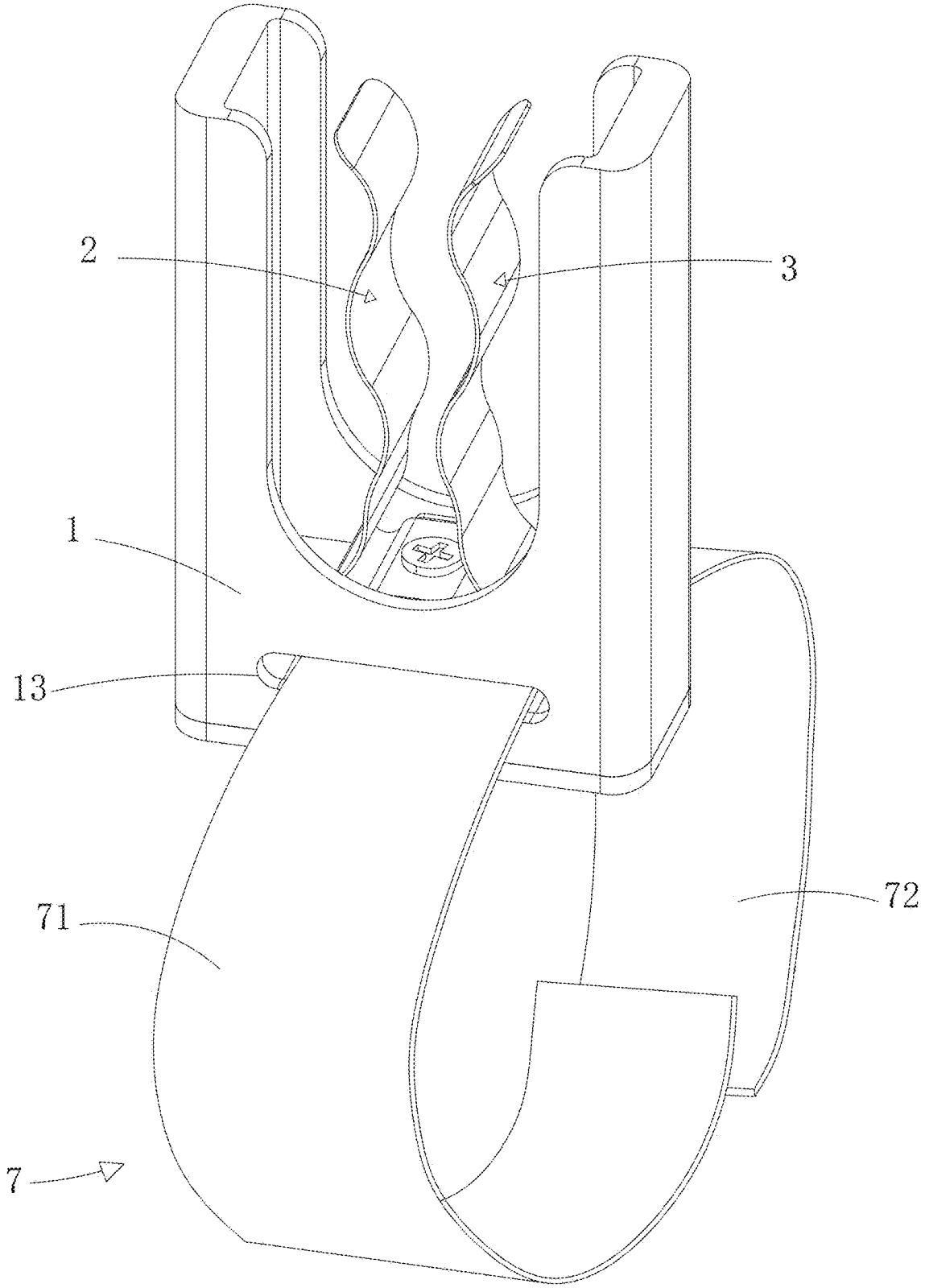
FIG. 10 is a schematic view of a seat and a connection band being used cooperatively according to some embodiments of the present disclosure.

In addition, in order to allow the tobacco product holding device to be mounted in various manners, the tobacco product holding device may also be mounted to an object that cannot be magnetically attracted. In an embodiment, as shown in FIG. 10, the seat 1 defines a connection hole 13 extending through the seat 1, the connection hole 13 extends through the base 101 and the outer housing 102 in the front-rear direction. The tobacco product holding device further includes a connection band 7, and the connection belt 7 extends through the connection hole 13. One of two sides of the connection belt 7 is a hairy surface 71, and the other one of two sides of the connection belt 7 is a hook surface 72. Therefore, the connection belt 7 is configured as a Velcro structure. That is, the hairy surface 71 of the connection belt 7 can be connected to the hook surface 72. The connection belt 7 is arranged to allow the tobacco product holding device to be tied to an object for fixation.

Obviously, the above description provides only some of, not all of, the embodiments of the present disclosure. The accompanying drawings provide preferred embodiments of the present disclosure but do not limit the scope of the present disclosure. The present disclosure may be achieved in various forms. Conversely, these embodiments are provided for the purpose of providing a more thorough and comprehensive understanding of the present disclosure. Although the present disclosure has been described in detail with reference to the foregoing embodiments, any ordinary skilled person in the art may modify the technical solutions in the foregoing specific embodiments or may make equivalent substitutions for some technical features therein. Any equivalent structure made based on the specification and the accompanying drawings of the present disclosure, applied directly or indirectly in other related technical fields, shall all be equivalently within the scope of the present disclosure.

What is claimed is:

1. A tobacco product holding device, comprising:

a seat;

a magnetic member;

a first holding member, mounted on the seat and having a first holding portion and a second holding portion;

a second holding member, mounted on the seat;

wherein a first gap is defined between the first holding portion and the second holding member, the first holding member is configured to resiliently move in a direction away from the second holding member to increase a size of the first gap to be capable of receiving a tobacco product; the first holding member and the second holding member are configured to take a resilient force to clamp the tobacco product received in the first gap;

at least one of the first holding member and the second holding member having a guiding surface extending towards the first gap, the guiding surface is configured to guide the tobacco product to enter the first gap;

wherein the seat comprises:

a base, having a connection tab, a mounting slot being defined in a bottom of the base, wherein the first holding member and the second holding member are mounted on the connection tab, and the magnetic member is mounted in the mounting slot; and an outer housing, comprising a pair of protective tabs and defining a holding notch between the pair of protective tabs; a bottom of the outer housing further defines a connection slot extending upwardly and communicated to the holding notch; the connection tab of the base is mounted in the connection slot;

wherein an extending height of each of the pair of protective tab is slightly greater than a height of the first holding member or a height of the second holding member; and the first holding member and the second holding member are entirely disposed inside the holding notch.

2. The tobacco product holding device according to claim 1, wherein, an end of the first holding member away from the seat is a guiding end, the guiding end is inclined upwardly in a direction away from the second holding member, a side of the guiding end facing towards the second holding member forms the guiding surface.

3. The tobacco product holding device according to claim 1, wherein, an end of the first holding member away from the seat is a first guiding end, an end of the second holding member away from the seat is a second guiding end; the first guiding end of the first holding member and the second guiding end of the second holding member extend in opposite directions and are inclined upwardly; and a surface of the first guiding end opposite to the second guiding end forms a first guiding surface, a surface of the second guiding end opposite to the first guiding end forms a second guiding surface.

4. The tobacco product holding device according to claim 1, wherein, a side of the first holding portion facing the second holding member has a first curved slot.

5. The tobacco product holding device according to claim 1, wherein a second gap is defined between the second holding portion and the second holding member; the second gap is communicated to the first gap, another tobacco product is capable of being held in the second gap.

6. The tobacco product holding device according to claim 5, wherein the second holding portion is disposed closer to the seat than the first holding portion is; and when the first holding member and the second holding member are not holding the tobacco product, a width at a widest position of the second gap is less than a width at a widest position of the first gap;

a side of the second holding portion facing the second holding member has a second curved slot.

7. The tobacco product holding device according to claim 5, wherein the first holding member comprises a lower segment and an upper segment arranged along a down-to-up direction, the lower segment is arranged on the seat, a side of the lower segment facing the second holding member is inclined in the down-to-up direction towards the second holding member, the first holding portion is arranged on the upper segment, the second holding portion is arranged on the lower segment.

8. The tobacco product holding device according to claim 7, wherein a side of the upper segment facing the second holding member is inclined along the down-to-up direction away from the second holding member.

9. The tobacco product holding device according to claim 7, wherein the second transition portion is formed at a junction between the lower segment and the upper segment, a third gap is defined between the second transition portion and the second holding member; and the first gap, the third gap, and the second gap are communicated to each other sequentially; and when the first holding member and the second holding member are not holding the tobacco product, a width of the third gap at a narrowest position is in a range of 0.5 cm to 1 cm.

10. The tobacco product holding device according to claim 5, wherein, when the first holding member and the second holding member are not holding the tobacco product, a width of the second gap at a widest position is in a range of 0.7 cm to 1.3 cm.

11. The tobacco product holding device according to claim 1, wherein the first holding member and the second holding member are structures symmetrical to each other, the second holding member is capable of resiliently oscillating in a direction away from or approaching the first holding member.

12. The tobacco product holding device according to claim 1, wherein, when the first holding member and the second holding member are not holding the tobacco product, a width of the first gap at a widest position is in a range of 1.2 cm to 1.8 cm.

13. The tobacco product holding device according to claim 1, wherein each of the first holding member and the second holding member is in a sheet structure, the first holding member is curved and bent to form the first holding portion and the second holding portion, and each of the first holding member and the second holding member is made of stainless steel.

14. The tobacco product holding device according to claim 1, further comprising a connection member, wherein the connection member is fixedly mounted to the seat; the first holding member and the second holding member are both connected to the connection member; the first holding member, the second holding member and the connection member are configured as a one-piece and integral structure.

15. The tobacco product holding device according to claim 1, wherein the seat defines a connection hole extending through the seat;

the tobacco product holding device further comprises a connection belt, the connection belt extends through the connection hole; one of two sides of the connection belt is a hairy surface, and the other one of two sides of the connection belt is a hook surface.

16. A tobacco product holding device, comprising:

a seat;

a first holding member, mounted on the seat and having a first holding portion;

a second holding member, mounted on the seat; and a magnetic member, mounted on the seat;

wherein a first gap is defined between the first holding portion and the second holding member, the first holding member is configured to resiliently move in a direction away from the second holding member to increase a size of the first gap to be capable of receiving a tobacco product; the first holding member and the second holding member are configured to take a resilient force to clamp the tobacco product received in the first gap;

wherein the seat comprises:

a base, having a connection tab, a mounting slot being defined in a bottom of the base, wherein the first holding member and the second holding member are mounted on the connection tab, and the magnetic member is mounted in the mounting slot; and an outer housing, comprising a pair of protective tabs and defining a holding notch between the pair of protective tabs; a bottom of the outer housing further defines a connection slot extending upwardly and communicated to the holding notch; the connection tab of the base is mounted in the connection slot;

wherein an extending height of each of the pair of protective tab is slightly greater than a height of the first holding member or a height of the second holding member; and the first holding member and the second holding member are entirely disposed inside the holding notch.

17. The tobacco product holding device according to claim 16, further comprising a sealing piece, the sealing piece is attached to the base and covers the mounting slot.

18. A tobacco product holding device, comprising:

a seat;

a first holding member, mounted on the seat and having a first holding portion;

a second holding member, mounted on the seat; and wherein a first gap is defined between the first holding portion and the second holding member, the first holding member is configured to resiliently move in a direction away from the second holding member to increase a size of the first gap to be capable of receiving a tobacco product; the first holding member and the second holding member are configured to take a resilient force to clamp the tobacco product received in the first gap;

wherein the seat is further arranged with a protective tab extending upwardly; the protective tab defines a holding notch extending in an up-to-down direction; the first holding member and the second holding member are arranged in the holding notch; the tobacco product is capable of extending through the holding notch to be held between the first holding member and the second holding member;

wherein an extending height of the protective tab is slightly greater than a height of the first holding member or a height of the second holding member; and the first holding member and the second holding member are entirely disposed inside the holding notch.

19. The tobacco product holding device according to claim 18, wherein the seat comprises:

a base, having a connection tab, wherein the first holding member and the second holding member are mounted on the connection tab; and an outer housing, wherein the protective tab and the holding notch are arranged on the outer housing; a bottom of the outer housing further defines a connection slot extending upwardly and communicated to the holding notch; the base is fixedly connected to the bottom of the outer housing, the connection tab is inserted into the connection slot.

* * * * *